United States Patent [19]

Stumpp et al.

[11] Patent Number: 4,589,596

[45] Date of Patent: May 20, 1986

[54] NOZZLE FOR INTERNAL COMBUSTION ENGINES

[75] Inventors: Gerhard Stumpp, Stuttgart; Karl Hofmann, Remseck; Jürgen Treiber; Horst Wellein, both of Bamberg, all of Fed. Rep. of Germany

[73] Assignee: Robert Bosch GmbH, Stuttgart, Fed. Rep. of Germany

[21] Appl. No.: 220,665

[22] Filed: Dec. 29, 1980

[30] Foreign Application Priority Data

Jan. 3, 1980 [DE] Fed. Rep. of Germany ..... 3000061

[51] Int. Cl.[4] ..... B05B 15/00

[52] U.S. Cl. ..... 239/397.5; 123/470; 239/533.2; 239/600

[58] Field of Search ..... 239/397.5, 533.2–533.12, 239/584, 585, 600; 123/470

[56] References Cited

U.S. PATENT DOCUMENTS

| | | | |
|---|---|---|---|
| 3,717,305 | 2/1973 | Hedges | 123/470 |
| 3,941,109 | 3/1976 | Schmid | 123/470 |
| 4,007,880 | 2/1977 | Hans et al. | 239/600 |
| 4,296,887 | 10/1981 | Hofmann | 239/397.5 |

FOREIGN PATENT DOCUMENTS

| | | | |
|---|---|---|---|
| 2833090 | 2/1980 | Fed. Rep. of Germany | 239/397.5 |
| 685444 | 7/1930 | France | 239/397.5 |

*Primary Examiner*—Joseph F. Peters, Jr.
*Assistant Examiner*—Michael J. Forman
*Attorney, Agent, or Firm*—Edwin E. Greigg

[57] ABSTRACT

A nozzle holder for internal combustion engines is proposed, in which a sleeve can be secured in the cylinder head by means of a tightening nut. The sleeve protects the portion of the nozzle which protrudes into the combustion chamber from thermal effects. Ease of serviceability is attained in that when the nozzle holder is rotated out of the cylinder head, the sleeve is simultaneously removed, without requiring additional hand operations.

13 Claims, 4 Drawing Figures

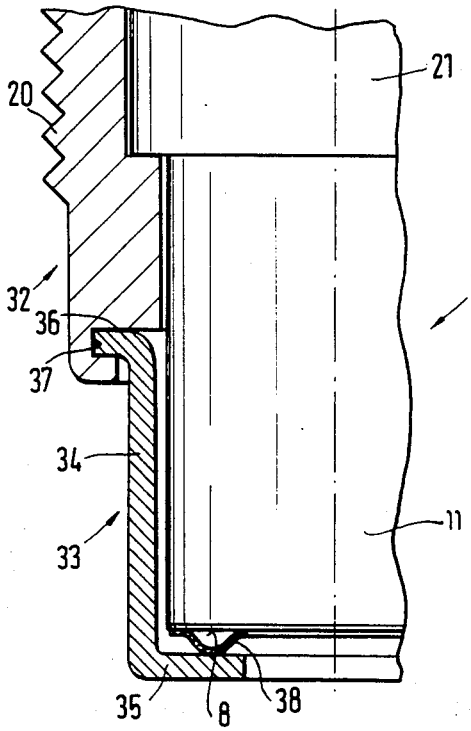
FIG.2
FIG.3
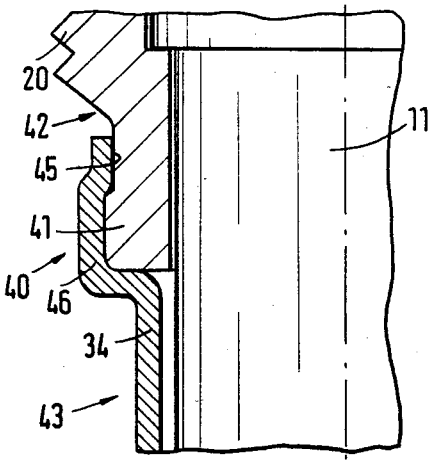
FIG.4
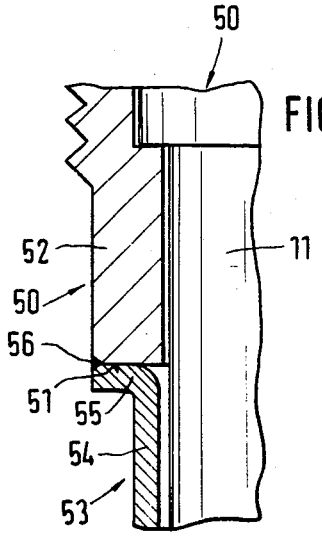

NOZZLE FOR INTERNAL COMBUSTION ENGINES

BACKGROUND OF THE INVENTION

A heat insulation part embodied as a slotted disc is known, which is pressed by a tightening nut against the shoulder of the recessed bore of the cylinder head of the internal combustion engine. A sleeve-like heat insulation part is also known, whose outer collar is likewise pressed by the tightening nut against the shoulder of the recessed bore of the cylinder head.

The heat insulation part is of course replaced by a new part whenever the nozzle is changed. When the tightening nut is pushed out of the cylinder head, the nozzle is simultaneously expelled along with it; however, the heat insulation part is not. Particularly after a relatively long time in operation, the heat insulation part is usually stuck in place in the cylinder head, so that loosening and removing this part necessitates additional expense.

OBJECT AND SUMMARY OF THE INVENTION

According to the invention, a new nozzle is created which is easy to service, because no additional hand operations are required to remove the heat insulation part from the cylinder head.

Advantageous modifications of the invention are described herein. Only a relatively short tightening nut is required with the embodiment of the nozzle including a lip. Manufacture at favorable cost is possible if the nozzle is embodied with an integral threaded means and a sheath or where the threaded means includes an enlarged flange in close proximity to a collar.

The invention will be better understood and further objects and advantages thereof will become more apparent from the ensuing detailed description of preferred embodiments taken in conjunction with the drawings.

BRIEF DESCRIPTION OF THE DRAWINGS

Four exemplary embodiments of the invention are shown in the drawings, each in partial axial section and larger than actual size.

FIG. 2 shows a portion of a sleeve flanged into the tightening nut and having a separate heat insulation ring;

FIG. 3 also shows a portion of a sleeve and is a variant of the flanging of FIG. 2; and FIG. 4 also shows a portion of a sleeve welded onto the tightening nut.

DESCRIPTION OF THE PREFERRED EMBODIMENTS

Figure 1:
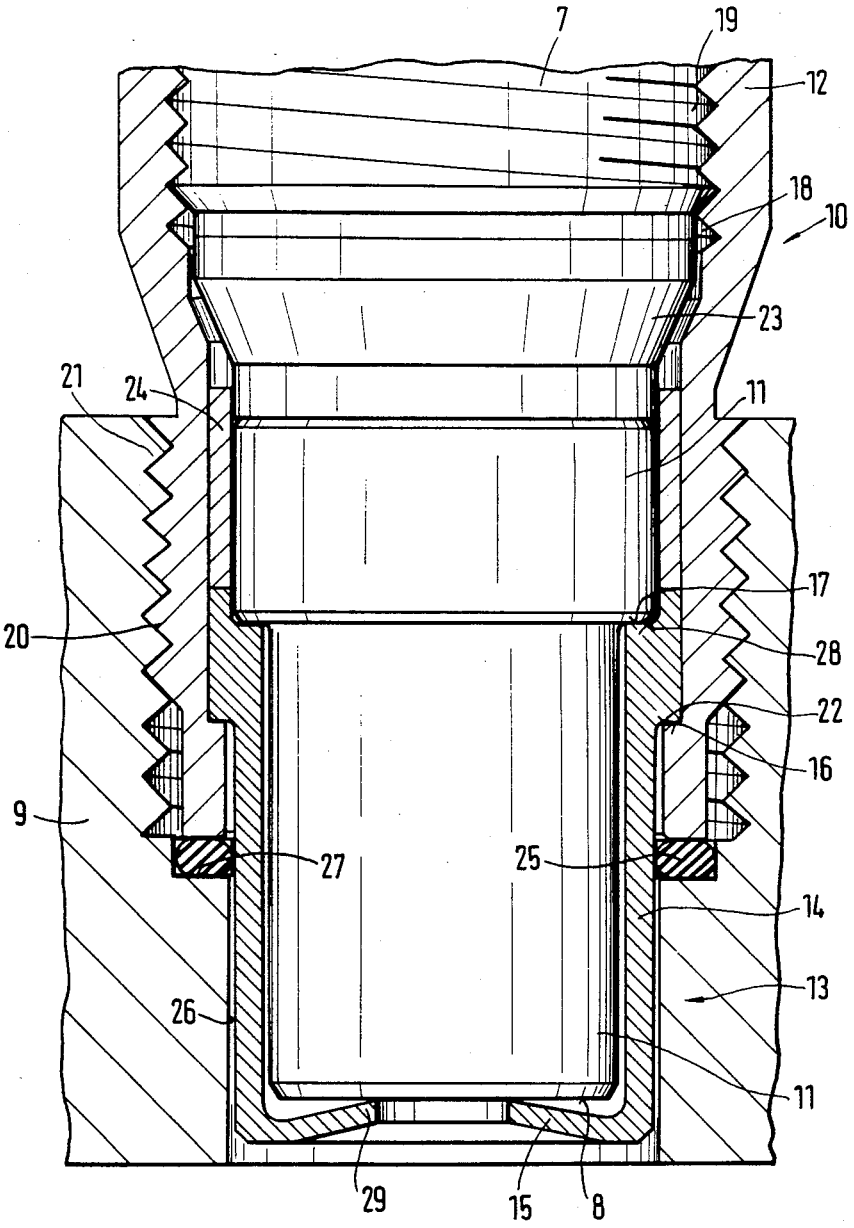
FIG. 1 shows the nozzle in elevation with an insertable sleeve.

FIG. 1 shows part of the cylinder head 9 of an internal combustion engine and part of a nozzle holder 20 having the nozzle 11, a tightening nut 12 and a sleeve 13 embodied as a heat insulation part. The sleeve 13 is a rotational body comprising a sheath 14 and an annular lip 15. An outer shoulder 16 and a step 17 which points inwards are shaped on the sheath 14.

The tightening nut 12 has an inner thread 18, which cooperates with an outer thread 19 of a holder body 7, and an outer thread 20 which can be inserted into a threaded hole 21 of the cylinder head 9. The end portion of the tightening nut 12 has a shoulder 22 which points radially inward and cooperates with the outer shoulder 16 of the sleeve 13.

In the event that an intermediate disc 23 is provided, then it is useful to insert a centering sheath 24 into the tightening nut 12. A step 27 adjoins the threaded hole 21, and the hole 21 merges with a bore 26 receiving the sleeve 13.

The nozzle holder is assembled as follows:

The sleeve 13 is inserted into the tightening nut 12 in such a manner that the shoulder 22 comes to rest on the shoulder 16. The nozzle 11 and then the intermediate disc 23 are then guided into the sleeve 13. The holder body 7 is then threaded into the tightening nut 12; this causes a deformation at the sealing edge 29 of the sleeve 13 and thus effects sealing.

Now the entire unit, the so-called nozzle holder combination, after the sealing ring 25 has been inserted into the cylinder head, is threaded into the cylinder head.

The second exemplary embodiment of FIG. 2 shows part of the nozzle holder 30 with the nozzle 11 and the tightening nut 32 with the sleeve 33. This part is produced by drawing, and it comprises a sheath-like section 34, a radial annular lip 35 and a flange 36 which points radially outward. This flange 36 is flanged into an inner groove 37 of the tightening nut 32, so that the sleeve 33 and the tightening nut 32 are unreleasably combined with one another. A heat insulation ring 38 which can be braced in the axial direction is braced between the annular lip 35 and the end face 8 of the end portion of the nozzle 11. The nozzle holder 30 is threaded with its outer thread 20 into the cylinder head, not shown here.

The tightening nut 42 of the nozzle holder 40 shown in FIG. 3 has a shoulder 41 and an adjacent inwardly-recessed area or collar portion 45. The sleeve 43, produced as a deep-drawn part, comprises a sheath-like section 34, the annular lip 35 (not shown here) and a flanging ring 46, the endpiece of which is flanged inward at the inwardly-recessed area 45; as a result the sleeve 43 and the tightening nut 42 are combined unreleasably with one another.

The tightening nut 52 of the nozzle holder 50 in FIG. 4 has a radially extending end face 51, and the sleeve 53, again produced by deep drawing, merges in its sheath-like section 54 with a radial outer flange 55, which is preferably unreleasably secured by means of an annular welding seam 56 to the end face 51 of the tightening nut 52. The sleeve 53 may have either an annular lip 15 resting on the end face 8 of the nozzle body 31, or a ring lip 35 pointing radially inward, with the heat insulation ring 38 interposed in elastic fashion between the ring lip 35 and the nozzle 11.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for use in a recessed bore of a cylinder head of an internal combustion engine comprising a nozzle body, a threaded nut means including inner and outer surfaces for securing said nozzle body in said recessed bore of said cylinder head, said threaded nut means including outer threads along one end portion of said outer surface for threading into said cylinder head and inner threads along one end portion of said inner surface; said threaded nut means including a shoulder on its inner surface in an area opposite said threads on said outer surface, a heat insulative sheath which is arranged to receive one end of said nozzle body in said cylinder head, said sheath including an axially extending annular lip end portion having an axially aligned aperture therein and an upper end having a radially outwardly extending shoulder portion, a holder body in axial alignment with said nozzle body, said holder body having a threaded portion on its outer surface for threading into said inner threaded end portion of said threaded means to hold said nozzle body in said threaded means, said shoulder on the inner surface of said threaded nut means being compatible with said radial outwardly extending portion of said sheath for removing said sheath from said cylinder head as said threaded means is removed to remove said nozzle body from said cylinder head.

2. A fuel injection nozzle as claimed in claim 1 wherein said axially extending annular lip portion on said sheath includes an annular lip area which abuts an end face of said nozzle.

3. A fuel injection nozzle as claimed in claim 2, wherein said annular lip area includes a reentrant portion.

4. A fuel injection nozzle as claimed in claim 2, wherein said annular lip area includes a circular rim which forms a seal with said end face of said nozzle.

5. A fuel injection injection nozzle as claimed in claim 2, wherein said sheath further includes means for supporting said nozzle and other means cooperative with said threaded means for axial movement of said sheath to increase the sealing of said annular lip area with said end face of said nozzle.

6. A fuel injection nozzle as claimed in claim 5, wherein said threaded nut means and said sheath have complementally formed interfitting flange portions.

7. A fuel injection nozzle as claimed in claim 5, wherein said threaded nut means has a reduced collar portion and said sheath is deformed to engage said collar portion and thereby form a seal therewith.

8. A fuel injection nozzle as claimed in claim 7, wherein said threaded nut means further includes an enlarged flange in close proximity to said collar.

9. A fuel injection nozzle as claimed in claim 3, 5, 6, 7, or 8, which includes a heat insulating ring disposed between said axially extending annular lip on said sheath and an end face of said nozzle.

10. A fuel injection nozzle as claimed in claim 1 in which said threaded means and said sheath are combined into a single unit and further includes a heat insulating ring disposed between said axially extending annular lip on said sheath and an end face of said nozzle.

11. A fuel injection nozzle as claimed in claim 1 in which said threaded means and said sheath are integral and further includes a heat insulating ring disposed between said axially extending annular lip on said sheath and an end face of said nozzle.

12. A fuel injection nozzle as claimed in claim 1 wherein said annular shoulder in an area opposite said outer threaded end portion of said threaded nut means is on the inner surface of said threaded nut means and said outer threaded end portion of said threaded nut means surrounds said radial outwardly extending shoulder portion on the upper end of said sheath.

13. A fuel injection nozzle as claimed in claim 1 wherein said annular shoulder near the threads on the outer threaded end portion of said threaded nut means is on the outer surface of said threaded nut means and said outer threaded end portion of said threaded nut means is surrounded by said upper end portion of said sheath.

* * * * *